US006909063B2

(12) United States Patent
Nam

(10) Patent No.: US 6,909,063 B2
(45) Date of Patent: Jun. 21, 2005

(54) METAL DOME SHEET IN MOBILE COMMUNICATION TERMINAL AND KEYPAD THEREOF

(75) Inventor: Sang Eun Nam, Gwangymyeong (KR)

(73) Assignee: LG Electronics Inc., Seoul (KR)

( * ) Notice: Subject to any disclaimer, the term of this patent is extended or adjusted under 35 U.S.C. 154(b) by 2 days.

(21) Appl. No.: 10/372,083

(22) Filed: Feb. 25, 2003

(65) Prior Publication Data

US 2004/0055862 A1 Mar. 25, 2004

(30) Foreign Application Priority Data

Sep. 23, 2002 (KR) ..... 10-2002-0057515

(51) Int. Cl.[7] ..... H01H 3/00; H01H 9/00
(52) U.S. Cl. ..... 200/406; 200/516; 200/314
(58) Field of Search ..... 200/5 A, 512–517, 200/310–314, 341, 406; 341/22

(56) References Cited

U.S. PATENT DOCUMENTS 5,924,555 A * 7/1999 Sadamori et al. ..... 200/512
6,373,008 B1 * 4/2002 Saito et al. ..... 200/310
6,548,779 B2 * 4/2003 Takahashi et al. ..... 200/516
6,593,537 B2 * 7/2003 Teruyama et al. ..... 200/515
6,604,278 B2 * 8/2003 Sera et al. ..... 29/622

* cited by examiner

*Primary Examiner*—Michael A. Friedhofer
(74) *Attorney, Agent, or Firm*—Fleshner & Kim, LLP

(57) ABSTRACT

A keypad of a mobile communication terminal includes a contact sheet having contacts preferably shaped as hemispherical domes which deflect to turn on/off switch contact point pairs on a printed circuit board. The contact sheet further includes band parts covering the domes and an insulating sheet having at least one pair of semicircular openings for exposing portions of the domes. The insulating sheet is preferably made of a light-reflecting material/color which disperses light to illuminate keys of the keypad.

43 Claims, 4 Drawing Sheets

Fig. 1- Related Art
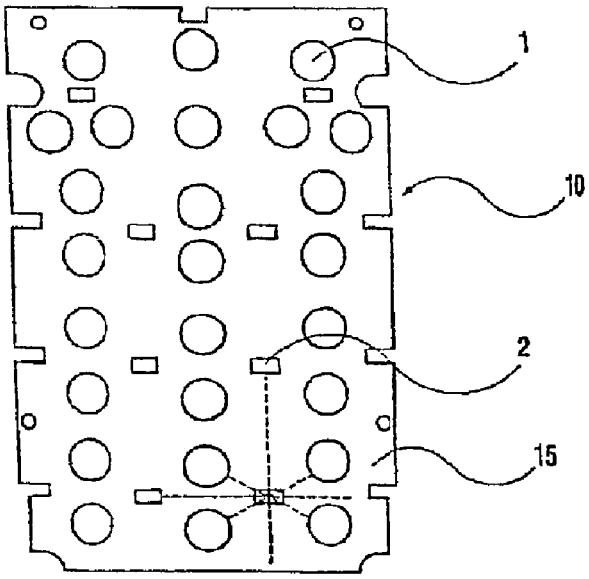
Fig. 2- Related Art
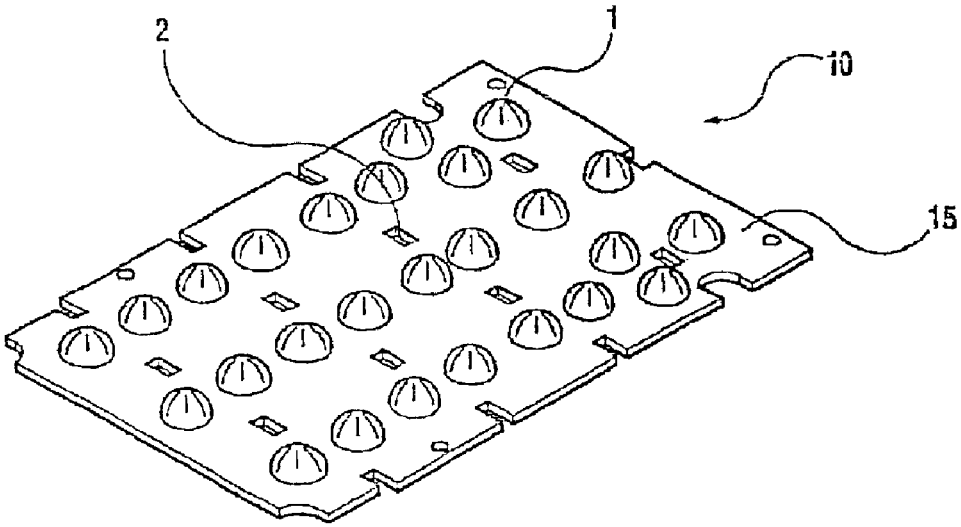

METAL DOME SHEET IN MOBILE COMMUNICATION TERMINAL AND KEYPAD THEREOF

BACKGROUND OF THE INVENTION

1. Field of the Invention

The present invention relates to a contact structure in an electronic device such as but not limited to a mobile communication terminal.

2. Background of the Related Art

Most mobile communication terminals have keypads for inputting characters or symbols, and the keypads usually have a contact sheet. In a related art terminal, the sheet is attached to a surface of a PCB (printed circuit board) having a plurality of keypad switches arranged thereon. The sheet includes a plurality of metal domes made of a metal based material (e.g., stainless steel) and the domes are attached onto the keypad switches respectively.

In operation, when a user presses a key (e.g., a character key), pressure is placed on the metal dome beneath the pressed key. This pressure causes the key to move and thus become distorted in a downward direction. As a result, the corresponding keypad switch is pressed by such distortion to bring about switch operation. The metal dome is useful because it gives a user's finger a feeling of click when pressed by the user, and also protects the corresponding keypad switch beneath the metal dome.

A related-art keypad includes a plurality of keys (character keys) formed by injection molding of synthesized resin such as acryl or the like. The keys have various characters or symbols formed thereon so that they may be distinguished from each other. Over time, a character or symbol printed on a surface of the key wears out and thus is hardly recognizable. To overcome this drawback, a specific color is coated on an inner face of the key using pigments. This color is partly removed to display a character or symbol. This method is widely used.

More specifically, in the foregoing keypad the character (symbol) is depicted by stripping off a portion of the colored surface using a laser. The portion representing the character is the stripped portion from which the color is removed, and it is transparent to allow for leakage of light emitted from inside. Hence, the user is able to distinguish and select keys conveniently. Also, it is noted that keypad switches are placed beneath the keypad to generate electric signals corresponding to the pressed keys. Once the key is pressed, the keypad switch is operated to generate the corresponding electric signal.

As previously discussed, a metal dome is frequently placed between the key and keypad switch to provide a "click" feeling to a user as well as to protect the switch. The keypad is formed from a plurality of the keys and an insulating sheet is usually attached to support a plurality of metal domes. An insulating sheet having metal domes attached thereto may be referred to as a metal dome sheet.

FIGS. 1 and 2 show different views of a metal dome sheet according to the related art. The metal dome sheet 10 includes a thin plate type insulating sheet 15 and metal domes 1 attached to the insulating sheet. Each metal dome 1 is made of a substantially hemispherical stainless steel plate. More specifically, each metal dome formed like a contact lens by cutting a portion of a sphere.

The insulating sheet 15 is mainly made of a white plastic sheet, and the number of the metal domes coincides with the number of keys to be placed on the metal domes. A plurality of holes 2 are formed between the metal domes. Light emitted from LEDs installed on a PCB (printed circuit board) having keypad switches, passes through the holes.

Problems may arise as a result of using the metal dome sheet of the related art when used in communications terminals. In these terminals, the keys keyboard) have a tendency to be too small to use. Hence, key size has to be increased.

As the size of the keys (keyboard) increases, so does a display portion for each number or character as well as width of each character style. However, if the size of the key or the width of the character or symbol increases, the corresponding metal dome beneath the key is seen externally through the wider and larger character potion of the key (keyboard).

A cut portion (numeral and character portion) of the key, which is cut by a laser, becomes dark due to the color of the corresponding metal dome. As a result, the light leaking through the key becomes hazy. Moreover, the metal dome protrudes out of the surface of the sheet to form a dome shape and blocks the light-propagating space to inhibit the flow of light. In FIG. 1, a light path is partially shown by a cutting line to show that light emitted from LED is blocked by the metal domes. Consequently, use of the metal domes inhibits bright illumination of the keys of the keyboard. Moreover, the metal domes are basically made of an opaque material, which thereby worsens the illumination problem.

A need therefore exists for an improved contact sheet which enables light to be evenly applied to a keypad, and which also prevents the color of the contacts from being exposed naturally.

SUMMARY OF THE INVENTION

An object of the present invention is to provide a contact sheet in an electronic device such as but not limited to a mobile communication terminal that substantially obviates one or more of the problems of the related art.

Another object of the present invention is to provide a contact sheet in a mobile communication terminal and a keypad thereof which enables light to be evenly applied to a keypad and which also prevents the color of the contacts on the sheet from being exposed to view by a user.

To achieve these and other objects and advantages, the present invention provides a contact sheet attached to a surface of a printed circuit board having keypad switch contact point pairs formed thereon. The contact sheet includes a plurality of contacts which are preferably in the form of hemispherical metal domes which are used to turn on/off the keypad switch contact point pairs of the printed circuit board, respectively. The contact sheet also includes a plurality of bands covering the metal domes respectively, an insulating sheet having at least one pair of semicircular openings formed at both sides of each of the band parts to expose an edge of each of the metal domes, and an adhesive agent layer inserted between a bottom of the insulating sheet and top surfaces of the metal domes and PCB to attach the metal domes and PCB to the insulating sheet. Preferably, a plurality of LED holes are formed in the insulating sheet so that light of at least one LED installed on the printed circuit board passes through the LED holes. Also, the metal dome sheet may further include an elastic plastic film coated on the insulating sheet and the metal domes exposed by the openings. The insulating sheet may be a white sheet having a property of diffused reflection, although any light-reflecting color may be used.

In another aspect of the present invention, a keypad in a mobile communication terminal includes a printed circuit board having a plurality of switch contact point pairs formed thereon, a plurality of hemispherical metal domes to connect the switch contact point pairs, respectively, a plurality of band parts covering the metal domes, respectively, and an insulating sheet having at least one pair of semicircular openings formed at both sides of each of the band parts to expose an edge of each of the metal domes.

Preferably, the keypad further includes an adhesive agent layer inserted between a bottom of die insulating sheet and top surfaces of the metal domes and PCB to attach the metal domes and PCB to the insulating sheet. A plurality of LED holes are formed in the insulating sheet so that light of at least one LED installed on the printed circuit board passes through the LED holes. Also, the keypad may include an elastic plastic film coated on the insulating sheet and the metal domes exposed by the openings. Preferably, the insulating sheet is a white sheet having a property of diffused reflection.

In a further aspect of the present invention, in a mobile communication terminal, the mobile communication terminal includes a keypad having a printed circuit board having a plurality of switch contact point pairs formed thereon, a plurality of hemispherical metal domes to connect the switch contact point pairs, respectively, a plurality of band parts covering the metal domes, respectively, and an insulating sheet having at least one pair of semicircular openings formed at both sides of each of the band parts to expose an edge of each of the metal domes.

Preferably, the mobile communication terminal further includes an adhesive agent layer inserted between a bottom of the insulating sheet and top surfaces of the metal domes and PCB to attach the metal domes and PCB to the insulating sheet, a plurality of LED holes formed in the insulating sheet so that light of at least one LED installed on the printed circuit board passes through the LED holes, and an elastic plastic film coated on the insulating sheet and the metal domes exposed by the openings, wherein the insulating sheet is a white sheet having a property of diffused reflection.

BRIEF DESCRIPTION OF THE DRAWINGS

FIG. 1 illustrates a layout of a metal dome sheet according to a related art for showing that LED light is blocked;

FIG. 2 illustrates a bird's-eye view of a metal dome sheet according to a related art;

DETAILED DESCRIPTION OF PREFERRED EMBODIMENTS

Figure 3:
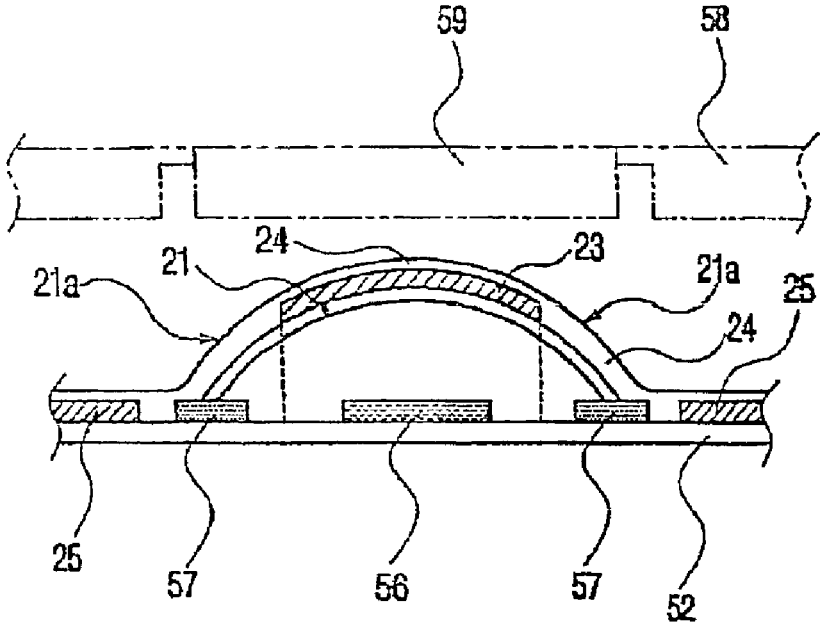
FIG. 3 illustrates a cross-sectional view of a keypad bisected along a cutting line V—V in FIG. 7.

Referring to FIG. 3, a contact sheet included in a mobile communications terminal according to the present invention is inserted between a keypad 58 and a printed circuit board (PCB) 52. The keypad has a plurality of keys 59 arranged thereon, the PCB 52 has keypad switch contact points 56 and 57 disposed under the corresponding key 59. The keypad 58 may be made of, for example, an elastic plastic material.

The PCB 52 may also include a plurality of LEDs 22*a* formed on the. PCB 52 for providing improved keypad illumination. Lines are also printed for connecting the switch contact points and the LEDs, as well as the key switch contact points 56 and 57.

The contact sheet 20 includes a plurality of contacts 21 and an insulating sheet 25 which covers the metal domes in order to attach them to the PCB 52. The contacts 21 are illustratively shown as being in the shape of metal domes, however other shapes may be used if desired.

Each of the metal domes is capable of being distorted by a force pressing a corresponding key 59. When this occurs, the metal dome will deflect downwardly to establish an electrical connection between the first and second contact points 56 and 57. The first and second contact points 56 and 57 thus serve as a key switch contact point pair, which thereby plays a role in turning on the key switch electrically as well as protecting the key switch contact points from external environmental influences such as dust, moisture, and the like.

Figure 4:
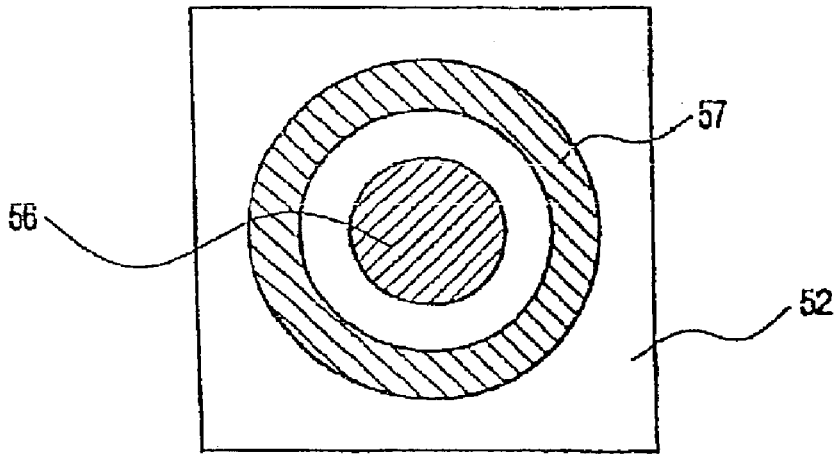
FIG. 4 illustrates a layout of a keypad according to the present invention for showing a contact point.
Figure 5:
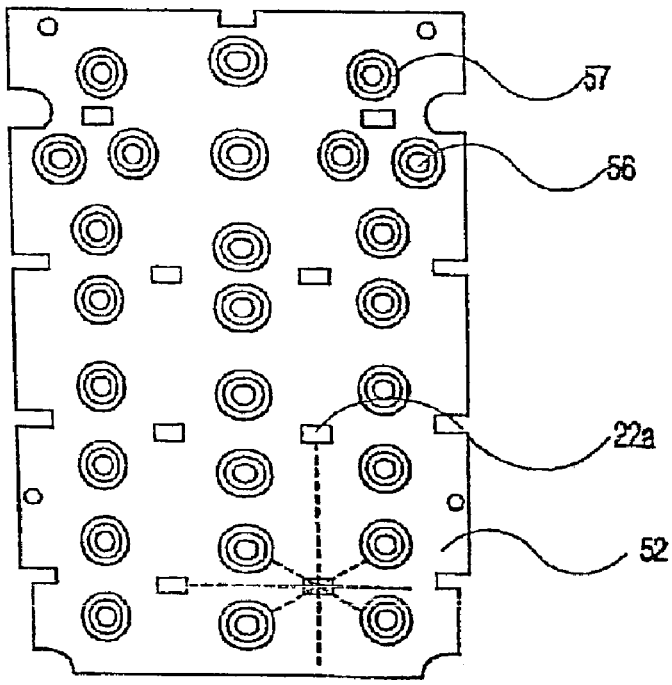
FIG. 5 illustrates a PCB layout of a keypad according to the present invention.

The metal domes are made of a conductive material such as, for example, stainless steel plate, and the sheet may be made of an insulating synthesized resin based material. An edge of the metal dome is in contact with the second contact point 57. In operation, when a central portion of the metal dome is pressed, it is distorted in a downward direction to establish contact with the first contact point 56, thereby electrically connecting the first and second contact points 56 and 57 to each other. See FIGS. 4 and 5.

Figure 6:
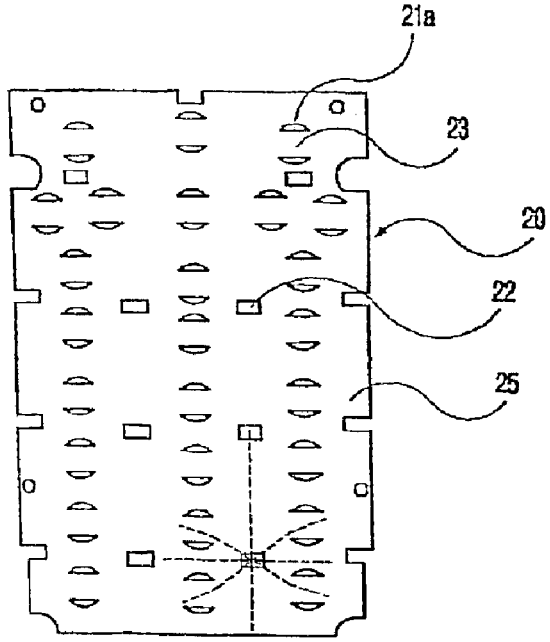
FIG. 6 illustrates a layout of a metal dome sheet according to the present invention.
Figure 7:
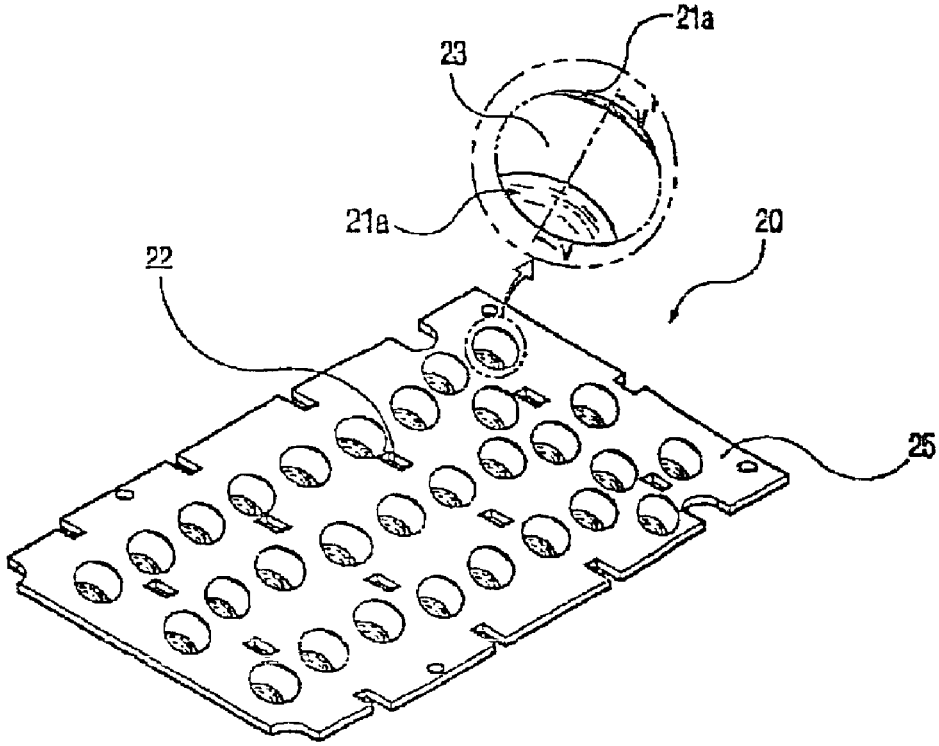
FIG. 7 illustrates a bird's-eye view of a metal dome sheet according to the present invention.

Referring to FIGS. 6 and 7, at least a portion of a top of the metal dome is covered with the insulating sheet, i.e., a band part 23. Openings 21*a* in the insulating sheet 25 expose edges of the metal dome. More specifically, two portions of the insulating sheet 25 are removed to provide a pair of half-moon-shaped openings 21*a*. While two openings 21*a* are preferably provided over each metal dome, those skilled in the art can appreciate that one or more openings in the insulating sheet 25 may be provided for each metal dome.

Referring to FIGS. 3 and 7, the insulating sheet 25 includes a band part 23 covering a substantially hemispherically shaped metal dome to connect the key switch contact points to each other, and a pair of the openings 21*a* at both sides of the band part 23 are provided to expose edges of the metal dome. While the openings are shown as being semicircular, those skilled in the art can appreciate that these openings may have any shape desired. The openings are advantageously formed to facilitate the distortion of the metal dome since the insulating sheet 25 has small elasticity. The insulating sheet 25 may further include an adhesive agent layer (attached to the insulating sheet and not shown in the drawing) between its bottom and tops of the metal dome 21 and PCB 52.

A plurality of LED holes 22 are formed in the insulating sheet 25 so that the light of the LEDs 22*a* on the PCB passes through the holes 22. See FIGS. 6 and 7.

An elastic thin plastic film 24 may be coated on entire surfaces of the insulating sheet 25 and each top of the metal domes exposed by the openings 21*a*. The plastic film 24 may be formed of vinyl coating or some other material. Such a film 24 plays a role in building the metal dome sheet in one body and protects the under structures from dust, moisture, and the like.

The insulating sheet 25 is preferably formed of a sheet having a light color such as but not limited to white. A light color is preferably for the insulating sheet 25 because such a color posses the property of diffused light reflection. It is a matter of course that various colors are applicable to the sheet for implementing various colors of the keypad.

A keypad according to the present invention therefore includes a PCB 52 having a plurality of switch contact points 56 and 57 formed thereon, at least one hemi-spherical metal dome 21 for connecting a switch contact point pair when the dome is deflected, at least one band part 23 covering the metal dome, an insulating sheet 25 having at least one pair of openings 21*a* (preferably semicircular) for exposing a pair of edges of the metal dome, and a keypad 58 having at least one key 59 arranged thereon in alignment over the corresponding metal dome. While such a keypad is suitable for inputting character or symbol signals into a mobile communication terminal, those skilled in the art can appreciate that the keypad may be used ill any type of electronic device.

The present invention is advantageous in a number of respects. For example, since each of the metal domes is directly covered with at least part of the sheet, the color of the metal domes fails to be seen externally between the keys or through the symbol portions of the keys. Instead, the color of the sheet is seen externally all the time.

Also, because light from the LEDs is reflected from the sheet uniformly, the characters or symbols can be distinguished or recognized with relative ease compared with the related art. For example, as shown in FIG. 6, light from the lens incident on the sheet on the metal dome is reflected therefrom at a point where a cutting line indicates a light path in part. Accordingly, the metal dome sheet according to the present invention prevents the metal dome from being seen through the numeral or character of the key. And, the LED light is transferred uniformly to illuminate the entire area of the keypad effectively.

Moreover, the metal dome sheet according to the present invention is modified from that of the related art in various ways, thereby being applicable to a mobile communication terminal to increase the product value as well as providing long endurance and convenience of use.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

For example, while the metal domes (or conductive contacts) of the present invention have substantially a semicircular shape, alternative embodiments of the invention may correspond to a contact structure having contacts 21 in other shapes, including but not limited to, rectangular or box shapes, conical or truncated conical shapes, as well as other shapes

What is claimed is:

1. A contact structure, comprising:

(a) a contact; and (b) a sheet comprising an insulating layer, including at least one band configured to partially cover a first portion of the contact, and to leave a second portion of the contact exposed so as to allow light to pass therethrough.

2. The contact structure of claim 1, wherein the sheet includes at least one opening formed therein and configured to expose the second portion of the contact.

3. The contact structure of claim 2, further comprising:

a transparent layer on the sheet, the second portion of the contact being exposed through the transparent layer and the at least one opening in the sheet.

4. The contact structure of claim 1, wherein the sheet is a white sheet.

5. The contract structure of claim 4, wherein the at least one opening is semicircular.

6. The contact structure of claim 1, wherein the contact comprises a dome shape.

7. The contact structure of claim 1, wherein the sheet has a light hole.

8. A keypad, comprising:

(a) a printed circuit board having a pair of switch contact points;

(b) a contact; and (c) a sheet comprising an insulating layer, including at least one band only partially covering the contact so as to allow light to pass through exposed portions of the contact.

9. The keypad of claim 8, wherein the sheet has an opening exposing the contact.

10. The keypad of claim 9, wherein the opening has a semicircular shape.

11. The keypad of claim 8, wherein the sheet includes a light hole, said light hole allowing light to reflect from said at least one band.

12. The keypad of claim 9, further comprising:

a film on the sheet, the contact exposed through the opening.

13. The keypad of claim 8, wherein the sheet is a white sheet.

14. A contact structure, comprising:

a contact; and an insulating layer at least partially covering a surface of the contact so as to allow light generated beneath the insulating layer to pass therethrough.

15. The contract structure of claim 14, wherein the insulating layer includes at least one opening which exposes a surface of the contact.

16. The contact structure of claim 15, wherein the at least one opening exposes a peripheral surface of the contact.

17. The contact structure of claim 15, wherein the at least one opening has a shape which is substantially semicircular.

18. The contact structure of claim 14, wherein the insulating layer has a light color.

19. The contact structure of claim 18, wherein the insulating layer is white.

20. The contact structure of claim 14, wherein the insulating layer has a light-diffusing color.

21. The contact structure of claim 14, further comprising:

a layer formed over the insulating layer.

22. The contact structure of claim 14, wherein the contact has at least substantially a dome shape.

23. The contact structure of claim 14, wherein the insulating layer includes a portion which forms a band across a surface of the contact, wherein a width of the band is less than a width of the contact.

24. The contact structure of claim 14, wherein the insulating layer completely covers the contact.

25. A keypad, comprising:

a key switch; and a contact structure adjacent the key switch, said contact structure including:

(a) a contact, and (b) an insulating layer at least partially covering a surface of the contact so as to allow light to pass therethrough.

26. The keypad of claim 25, further comprising:

a key, wherein the contact structure is located between the key and the key switch.

27. The keypad of claim 26, further comprising:

a light source, wherein the key has a window for emitting light from the light source.

28. The keypad of claim 27, wherein the window is in a shape of a symbol or character.

29. The keypad of claim 28, wherein the character is an alphanumeric character.

30. The keypad of claim 27, wherein the insulating layer has a light-reflecting color and wherein at least a portion of the insulating layer and the window of the key are aligned along a predetermined axis.

31. The keypad of claim 30, wherein the light-reflecting color is white.

32. The keypad of claim 30, wherein the light source is located at a position which allows the portion of the insulating layer at least partially covering the contact to reflect light from the light source through the window in the key.

33. The keypad of claim 30, further comprising:

at least a second key having a window, wherein said second key is adjacent another contact structure which includes a second contact which is at least partially covered by a light reflecting layer, and wherein the light source is located at a position which allows the light reflecting layer at least partially covering the second contact to reflect light from the light source through the window in said second key.

34. The keypad of claim 26, wherein the contact has a thickness which allows the contact to deflect under an application of pressure.

35. The keypad of claim 34, wherein the key switch includes a first contact point and a second contact point, and wherein the contact is at a location relative to the key switch which allows the contact to connect the first contact point and the second contact point when the contact deflects under said application of pressure.

36. The keypad of claim 35, wherein the first contact point is substantially in a shape of a circle and the second contact point is substantially in a shape of a ring.

37. The keypad of claim 36, wherein the first contact point is located at a center of the ring formed by the second contact point.

38. The keypad of claim 26, wherein the insulating layer includes at least one opening which exposes a surface of the contact.

39. The keypad of claim 38, wherein the opening exposes a peripheral surface of the contact.

40. The keypad of claim 38, wherein the opening has a shape which is substantially semicircular.

41. The keypad of claim 26, wherein the insulating layer completely covers the contact.

42. A terminal including a keypad as recited in claim 25.

43. A contact structure, comprising:

a contact;

a sheet, comprising a band partially covering the contact, and an opening exposing a portion of the contact; and a transparent layer on the sheet, the contact being exposed through the transparent layer and the opening in the sheet.

* * * * *